US006638023B2

(12) United States Patent
Scott

(10) Patent No.: US 6,638,023 B2
(45) Date of Patent: Oct. 28, 2003

(54) METHOD AND SYSTEM FOR ADJUSTING OPERATING PARAMETERS OF COMPUTER CONTROLLED PUMPS

(75) Inventor: Thomas R. Scott, Exton, PA (US)

(73) Assignee: Little Giant Pump Company, Oklahoma, OK (US)

( * ) Notice: Subject to any disclaimer, the term of this patent is extended or adjusted under 35 U.S.C. 154(b) by 87 days.

(21) Appl. No.: 10/041,288

(22) Filed: Jan. 7, 2002

(65) Prior Publication Data

US 2002/0090303 A1 Jul. 11, 2002

Related U.S. Application Data

(60) Provisional application No. 60/260,033, filed on Jan. 5, 2001, and provisional application No. 60/287,753, filed on May 1, 2001.

(51) Int. Cl.[7] ..... F04B 49/00
(52) U.S. Cl. ..... 417/36; 417/40; 417/44.11
(58) Field of Search ..... 417/12, 36, 40, 417/44.11, 53

(56) References Cited

U.S. PATENT DOCUMENTS 2,219,472 A * 10/1940 Defandorf et al. ..... 417/12
4,121,094 A * 10/1978 DiVito et al. ..... 417/36
4,204,801 A * 5/1980 Kamo ..... 417/36
4,357,131 A * 11/1982 Guillemot ..... 417/12
4,437,811 A * 3/1984 Iwata et al. ..... 417/40
4,919,343 A * 4/1990 Van Luik, Jr. et al. ..... 241/36
5,028,212 A * 7/1991 Brophey et al. ..... 417/12
5,553,794 A * 9/1996 Oliver et al. ..... 417/36
6,322,325 B1 * 11/2001 Belehradek ..... 417/40
6,481,973 B1 * 11/2002 Struthers ..... 417/36
2002/0106280 A1 * 8/2002 Beard et al.

* cited by examiner

*Primary Examiner*—Cheryl J. Tyler
(74) *Attorney, Agent, or Firm*—Drinker Biddle & Reath LLP

(57) ABSTRACT

A system and methods for automatically adjusting pump operating parameters for at least one pump to accommodate solids encountered during a pumping operation. The output signal of a level sensor may be monitored so as to detect and account for variations therein. The power draw of the pump may also be monitored so as to detect and account for the presence of solids.

19 Claims, 9 Drawing Sheets

METHOD AND SYSTEM FOR ADJUSTING OPERATING PARAMETERS OF COMPUTER CONTROLLED PUMPS

PRIORITY INFORMATION

This application claims priority from provisional application 60/260,033 filed Jan. 5, 2001 and from provisional application 60/287,753 filed May 1, 2001 both of which are hereby incorporated by reference in their entirety.

FIELD OF THE INVENTION

The subject invention relates generally to a system and methods for adjusting operating parameters of computer controlled pumps where solids may be encountered during a pumping operation. The present invention provides for overcoming buildups on a capacitance level sensor as well as preventing debris from causing a pump to stop functioning properly. The output signal of a level sensor may be monitored so as to detect and account for variations therein. The power draw or current of the pump may also be monitored so as to detect and account for the presence of solids.

BACKGROUND OF THE INVENTION

A variety of pumps such as grinder pumps, for example, are widely used in many different applications to pump liquids containing various forms of solids. Such pumps are often installed in tanks or other containers suitable for storing fluids. The pumps are turned on and off automatically by external or internal liquid level controls. The level controls typically provide some sort of indicator or signal that is transmitted to the pump. The value of the signal is adapted to correspond to the level of fluid within the tank and the pump is programmed to turn on and off at predetermined values of the signal. During normal operation, the level sensor output signal is used to determine when the pump should turn on and off for purposes of pumping liquid from a tank. Solids and/or debris encountered during a pumping operation often become attached to the level sensor element, i.e. the input portion of the level control system located within the tank. To ameliorate the effects of small buildups on the sensor element, a software program may be utilized to periodically recalibrate the level sensor so as to avoid variations in the value of the output signal as it corresponds to the fluid level. However, in cases of extreme buildup on the level sensor element, the level sensor's output signal will become attenuated causing significant variations in the value of the output signal that corresponds to the fluid level. If the attenuation is great enough, no amount of fluid level increase will initiate a pumping cycle thereby potentially causing an overflow situation.

Debris encountered during a pumping operation may also cause problems in regard to the pump itself. Normally, debris located within the tank that ends up being drawn into the pump inlet is ground up and exits the pump outlet. Problems may arise when the fluid level drops below the point at which the pump is programmed to turn off and consequently the level controls turn the pump off while it is in the process of grinding something. In such situations, the pump may have insufficient torque to restart when the fluid level goes back up above the point at which the pump is programmed to turn on. If the pump is not capable of restarting, the debris must be manually cleared from the pumps' cutters. Obviously, manually clearing the pumps' cutters so as to enable the pump to restart is time consuming and expensive.

It is therefore desirable to provide a system for adjusting pump operating parameters so as to account for the detrimental effects that may be caused by solids encountered during a pumping operation.

SUMMARY OF THE INVENTION

In accordance with the present invention, there is provided a system and methods for adjusting operating parameters of computer controlled pumps where solids may be encountered during a pumping operation. The system and methods enable operating parameters of a pump to be adjusted in accordance with the degree to which solids are affecting a pumping operation.

In one embodiment of the present invention, there is provided a method for adjusting pump operating parameters for at least one pump to accommodate solids encountered during a pumping operation, the method comprising the steps of:

a) providing a level sensor adapted to provide an output signal corresponding to a fluid level;

b) assigning a value of the output signal to correspond to a predetermined maximum fluid level;

c) assigning a value of the output signal to correspond to a predetermined minimum fluid level;

d) programming the pump to turn on when the output signal is at a certain predetermined value and off when the output signal is at another predetermined value, the predetermined values being less than the value that corresponds to the maximum fluid level and greater than the value that corresponds to the minimum fluid level; and e) monitoring the values of the output signal that correspond to the maximum and minimum fluid levels so as to periodically update the values at which the pump will turn on and off in accordance with variations that may occur in the values of the signal that correspond to the maximum and minimum fluid levels.

In another embodiment of the present invention, there is provided a method for adjusting pump operating parameters for at least one pump to accommodate solids encountered during a pumping operation, the method comprising the steps of:

a) providing a level sensor adapted to provide an output signal corresponding to a fluid level;

b) assigning a value of the output signal to correspond to a predetermined maximum fluid level;

c) assigning a value of the output signal to correspond to a predetermined minimum fluid level;

d) programming the pump to turn on when the output signal is at a certain predetermined value and off when the output signal is at another predetermined value, the predetermined values being less than the value that corresponds to the maximum fluid level and greater than the value that corresponds to the minimum fluid level; and e) monitoring the values of the output signal that correspond to the maximum and minimum fluid levels so as to periodically update the values at which the pump will turn on and off in accordance with variations that may occur in the values of the signal that correspond to the maximum and minimum fluid levels.

In another embodiment of the present invention, there is provided a method for adjusting pump operating parameters for at least one pump to accommodate solids encountered during a pumping operation, the method comprising the steps of:

a) providing a level sensor adapted to provide an output signal corresponding to a fluid level;

b) assigning a value of the output signal to correspond to a predetermined maximum fluid level;

c) assigning a value of the output signal to correspond to a predetermined minimum fluid level;

d) programming the pump to turn on when the output signal is at a certain predetermined value and off when the output signal is at another predetermined value, the predetermined values being less than the value that corresponds to the maximum fluid level and greater than the value that corresponds to the minimum fluid level;

e) taking a first reading of the value of the output signal generated by the level sensor in response to an alarm signal indicating that the level of fluid is above the maximum fluid level and that the pump has not begun pumping;

f) adjusting the value of the output signal that corresponds to the maximum fluid level so that the value of the output signal taken as the first reading now corresponds to the maximum fluid level;

g) reducing the level of fluid to below the minimum fluid level;

h) taking a second reading of the value of the output signal generated by the level sensor while the fluid level is below the minimum fluid level;

i) adjusting the value of the output signal that corresponds to the minimum fluid level so that the value of the output signal taken as the second reading now corresponds to the minimum fluid level; and j) using the values of the output signal taken as the first and second reading to calculate new output signal values at which the pump will turn on and off.

In another embodiment of the present invention, there is provided a system pump operating parameters of at least one pump may be adjusted to accommodate solids encountered during a pumping operation, the system comprising:

a) at least one pump;

b) a level sensor adapted to provide an output signal corresponding to a fluid level wherein a value of the output signal is predetermined to correspond to a predetermined maximum fluid level and a value of the output signal is predetermined to correspond to a predetermined minimum fluid level;

c) the system being adapted to cause the pump to turn on when the output signal is at a certain level and off when the output signal is at another predetermined value wherein the predetermined values are within the range of values that correspond to the minimum and maximum fluid levels;

d) at least one microprocessor adapted to monitor the output signal of the level sensor and periodically recalculate the values of the output signal at which the pump will turn on and off in accordance with variations that may occur in the values of the output signal that correspond to the maximum and minimum fluid levels; and e) at least one microprocessor adapted to determine whether the pump is grinding debris so that when the pump is grinding debris, the pump may continue grinding the debris regardless of whether the value of the output signal is below the value at which the pump would otherwise turn off.

In another embodiment of the invention, there is provided a method of adjusting pump operating parameters for at least one pump to accommodate solids encountered during a pumping operation, the method comprising the steps of:

a) providing a level sensor adapted to provide an output signal corresponding to a fluid level;

b) programming the pump to begin pumping when the level of fluid rises above a predetermined maximum fluid level and stop pumping when the level of fluid falls below a predetermined minimum fluid level by assigning a value of the output signal to correspond to the maximum fluid level and a value of the output signal to correspond to the minimum fluid level; and c) monitoring the values of the output signal that correspond to the maximum and minimum fluid levels so as to periodically update the values of the output signal that correspond to the maximum and minimum fluid levels in accordance with variations that may occur in the values of the output signal that correspond to the maximum and minimum fluid levels.

BRIEF DESCRIPTION OF THE INVENTION

For the purpose of illustrating the invention, there is shown in the drawings a form which is presently preferred; it being understood, however, that this invention is not limited to the precise arrangements and methodologies shown.

DETAILED DESCRIPTION OF THE INVENTION

Figure 1:
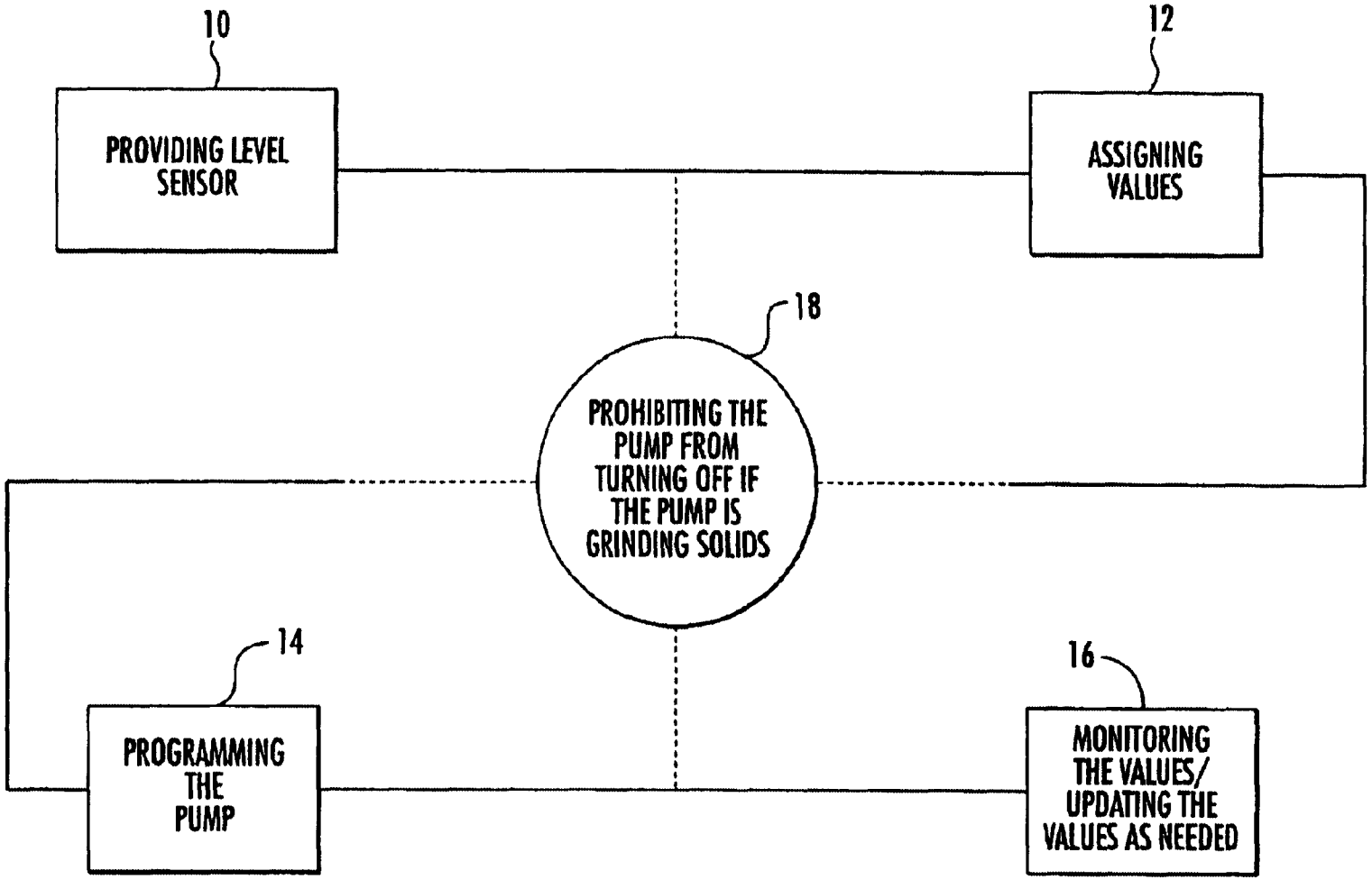
FIG. 1 is a flow chart summarizing how the operating parameters of a computer controlled pump are adjusted so as to account for solids encountered during a pumping operation in accordance with the present invention.

Referring now to the Figures, there is shown in FIG. 1 an embodiment of a method for adjusting operating parameters of a computer controlled pump in accordance with the present invention. Note, the terms solid and debris may be used interchangeably in this specification. In a preferred embodiment of the present invention, the method is utilized in conjunction with a pump control system. The pump control system is preferably controlled by computers. Computers should not be construed in a limiting sense as any control system involving or utilizing any type of circuitry, electricity and/or electronics is well within the scope of the present invention. A typical pump control system may include a level sensor, a high alarm float, and circuitry for turning the pump on and off.

The values of the output signal that correspond to the maximum and minimum fluid levels may be referred to as a level reading and the maximum and minimum fluid levels may be referred to as maximum and minimum levels. The range of level sensor output signal values that relate to a level of fluid within a tank may be referred to as a span when describing the invention's ability to recalculate or re-scale those values as needed. A level sensor as used herein may by any type of level sensor means known to those in the art for controlling a pump. By way of example, the level sensor may be an electronic level sensor having a sensor element or a float type device. The invention is for accommodating solids encountered during a pumping operation. Solids may be referred to as debris and vice versa. Solids and debris are used as generic terms for anything that may impact a pumping operation including items such as fluids prone to coagulation or other items that are never or not always in a solid state. For example, cooking oils commonly adversely effect pumping operations when introduced into a sewer system by affecting the ability of a level sensor to accurately read the level of fluid in a tank. Sanitary napkins and other types of large items also adversely effect pumping operations by clogging pumps.

As can be seen from FIG. 1, the first step, indicated with reference numeral 10, is to provide a level sensor. The level sensor should be capable of providing an output signal that corresponds to the level of fluid in a tank or whatever container happens to be being used as a fluid storage medium. That is, the output signal of the level sensor should be indicative of a fluid level. Typical level sensors include a level sensor element that is located within the tank. The level sensor element is the means by which the level sensor obtains information regarding the fluid level. That information is interpreted by the level sensor and transmitted in the form of an output signal so as to control the operation of a pump. The output signal is typically transmitted in numerical format with units expressed in Volts Direct Current ("VDC"). By way of example, if the fluid level is at 25 inches above tank bottom, the corresponding output signal may be 1.8 VDC. The inputs and outputs may be expressed in any format so long as there is a predetermined criteria whereby the value of the output signal is indicative of the actual fluid level.

The next step 12 involves calibrating values of the output signal to correspond to maximum and minimum fluid levels as desired. Regardless of the size of the storage medium in which the fluid is located, a predetermined maximum and minimum fluid level may be established. The predetermined maximum and minimum fluid levels will vary as a function of the size of the storage medium. The predetermined maximum fluid level typically is a point that, if fluid rises much further, results in some sort of high alarm indicating an overflow situation may occur if a pumping cycle does not commence shortly.

The next step 14 involves programming the pump so that it will turn on and off at certain values of the output signal. The values of the output signal at which the pump should turn on and off are calculated using the values of the output signal predetermined as corresponding to the maximum and minimum fluid levels. Typically, the values at which the pump is programmed to turn on and off are within the range of the values that correspond to the maximum and minimum fluid values. Once the values at which the pump will turn on and off are established, the pump is programmed to turn on and off accordingly. Assuming 0.5 is predetermined to correspond to the minimum fluid level and 3.5 is predetermined to correspond to the maximum level, the values of the output signal at which the pump will turn off and on may be 0.9 VDC and 1.9 VDC, respectfully.

The final step 16 involves monitoring the values and updating them as needed. It is important to note that monitoring may be performed at any time during a pumping operation using a variety of methods as appropriate. In one embodiment, the values of the output signal that correspond to the maximum and minimum fluid levels are monitored. In other embodiments, the values at which the pump turns on and off may be monitored. It is also important to note that in some embodiments, the values at which the pump turns on and off may correspond to the maximum and minimum fluid values. Continuing with the embodiment where the values that correspond to the maximum and minimum fluid levels are monitored, the values may be monitored, as mentioned, in any manner known to those skilled in the art in a variety of ways at any point during a pumping operation as appropriate. Particular methods for monitoring the fluid levels will be described in detail below.

When a variation in the value of the output signal that corresponds to either the maximum or minimum fluid level is detected, adjustments are made so as to account for that variation. In the earlier example, 3.5 VDC corresponds to the maximum fluid level. However, if during the pumping operation, debris, solid or anything else disrupts the level sensor's ability to properly read the fluid level, the level sensor may provide an attenuated output signal. That is, when the fluid level reaches the maximum level, the level sensor, instead of transmitting the correct value of 3.5 VDC, may transmit a value of 1.5 VDC. This is a problem, especially where the pump is programmed to turn on at 1.9 VDC because the pump will not turn on despite the fluid level being at the maximum fluid level. Such situations, however, are detected and corrected in step 16.

Where the level sensor element is clean and providing an unattenuated output signal, the system monitors for a high alarm signal. If a high alarm signal is received, the values of the output signal will be updated as appropriate so as to account for attenuation of the level sensor. As mentioned, the level sensor may become attenuated when solids become attached to the sensor element. In response to a high alarm, a first reading of the value of the output signal is taken. That reading, i.e. the value of the output signal taken as the first reading, is stored as the value of the output signal that corresponds to the maximum fluid level. The pump is then energized until the fluid level falls below the minimum fluid level. That is done, in one embodiment, by reducing the fluid level until the pump breaks suction or the level reading otherwise bottoms out. At this point, a second reading of the value of the output signal is taken. That reading, i.e. the value of the output signal taken as the second reading, is stored as the value of the output signal that corresponds to the minimum fluid level. The level sensor has now been re-scaled and new values at which the pump will turn on and off are calculated by interpolating from the new maximum and minimum fluid levels. The pump operation is now operating in what, for convenience sake, can be referred to as attenuated mode.

While operating in attenuated mode, the values of the output signal are monitored and updated as needed to account for solids falling off the sensor element, for example. The new maximum and minimum values of the output signal will be updated as needed if any further changes in those values as they relate to the maximum and minimum fluid levels are detected. As mentioned, further variations in the output signal may arise as a result of the solids that caused the original attenuation becoming dislodged from the sensor element. In one embodiment, the system may monitor for further variations by periodically allowing the liquid level to rise above the maximum fluid level. If the value of the output signal continues to rise as the liquid level is allowed to rise above the maximum fluid level, the highest value of the output signal will become the value of the output signal that corresponds to the maximum fluid level. If the value of the output signal returns to normal by returning to the originally set maximum output value, which in this example is 3.5 VDC, the process of periodically raising the fluid level may cease. In another embodiment, the system may monitor for further variations by periodically allowing the liquid level to rise above the maximum sensor output reading. If the value of the output signal continues to rise as the liquid level rises above the maximum level reading, the system will track the level use until it stops. At that point, the system will store the output of the level sensor as the value of the output signal that corresponds to the maximum fluid level.

Of course, if another high alarm signal is triggered, the process may be implemented again as needed.

Moving along to step 18, at any point during the course of a pumping operation the pump is prohibited from turning off if the pump is grinding solids. This may be accomplished by continuously monitoring the power draw or the current flow of the pump so as to determine whether the pump is grinding solids. Determining whether the pump is grinding solids is possible because the electrical power drawn by a pump is proportional to the amount of work the pump is performing. That is, the pump works harder when grinding debris as opposed to pumping liquid. By monitoring the pump power draw or current with a voltage/current sensor, for example, a software program can be used to determine when the pump is grinding something and force it to stay on during that period. Users may, of course, use any alternate method for determining whether the pump is grinding solids and may also implement overriding features that cause the pump to turn off as desired. By way of example, one overriding feature may be some sort of time limit so that if something is in the pump that simply cannot be ground-up the pump will shut off so as to prevent damage thereto. Floats may also be used as part of the anti-clog function to prohibit the pump from turning off while it is grinding solids. The pump may also be prohibited from turning off while grinding solids without using a level sensor by, for example, programming the pump to turn on and off at present intervals.

Figure 2:
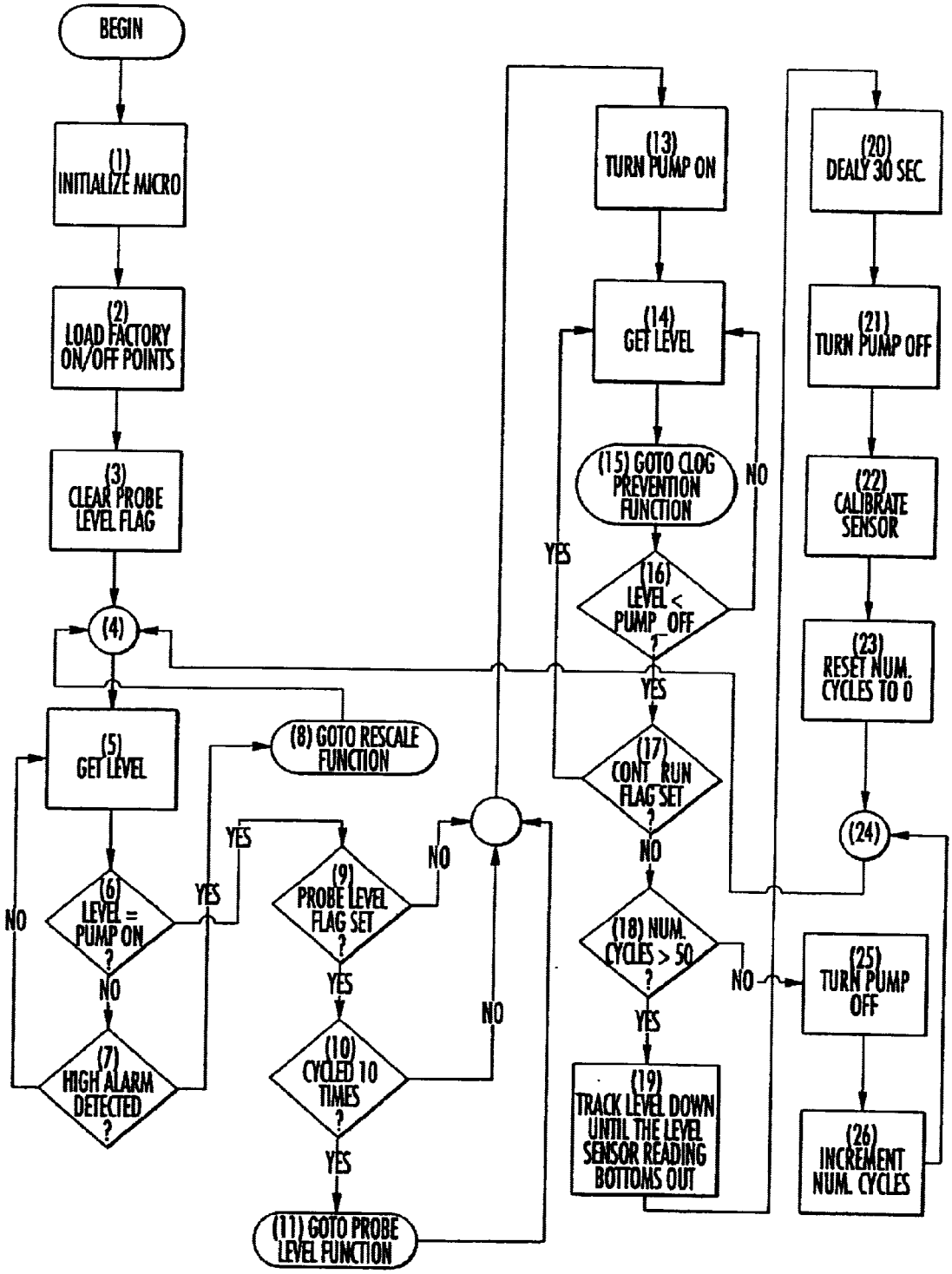
FIG. 2 is a flow chart illustrating steps performed as part of a main program loop in accordance with an embodiment of the present invention.
Figure 3:
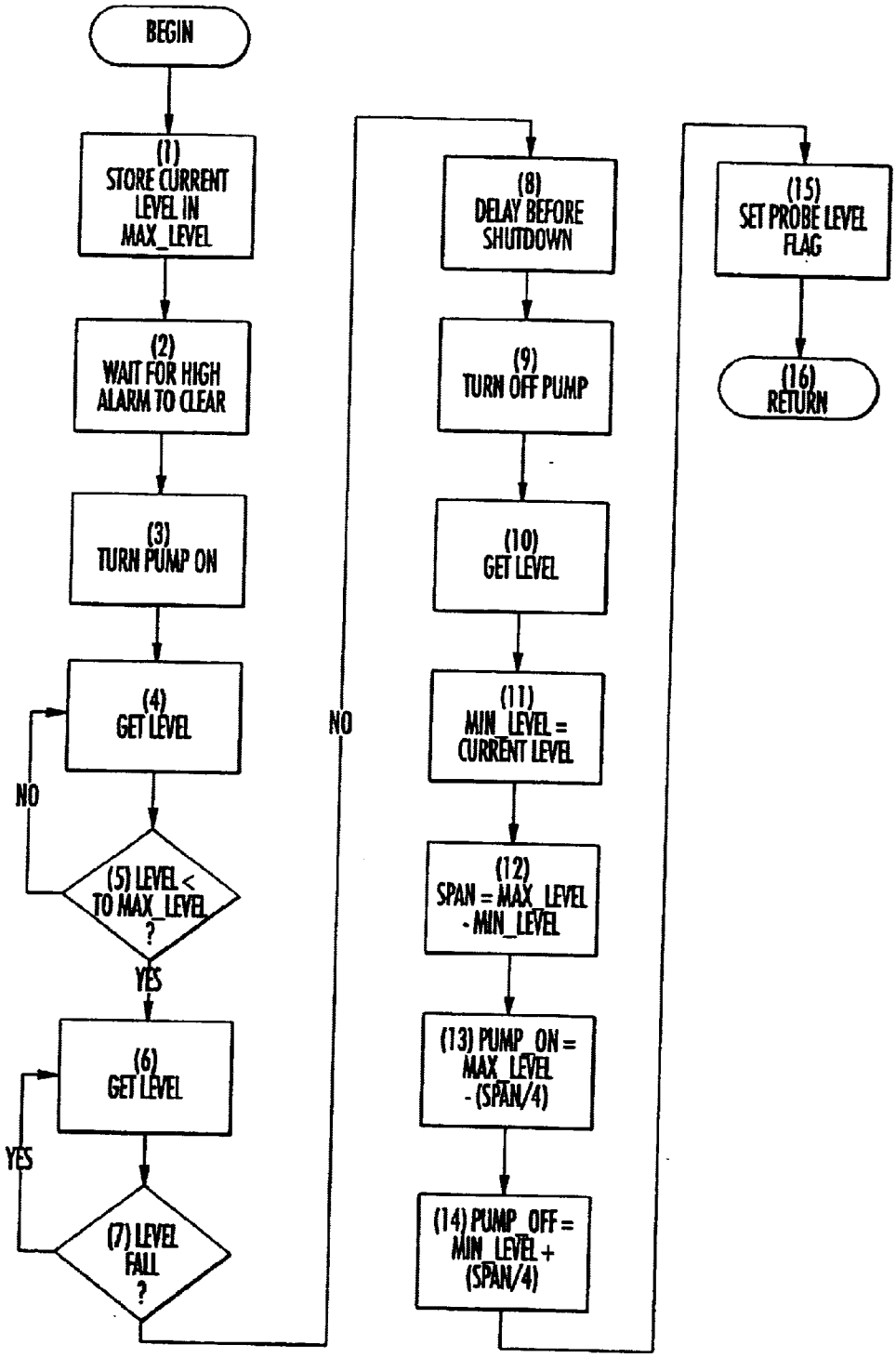
FIG. 3 is a flow chart illustrating steps performed as part of a subroutine of the main program loop to accommodate variations in an output signal of a level sensor as it corresponds to a level of fluid within a liquid storage container in accordance with an embodiment of the present invention.
Figure 4:
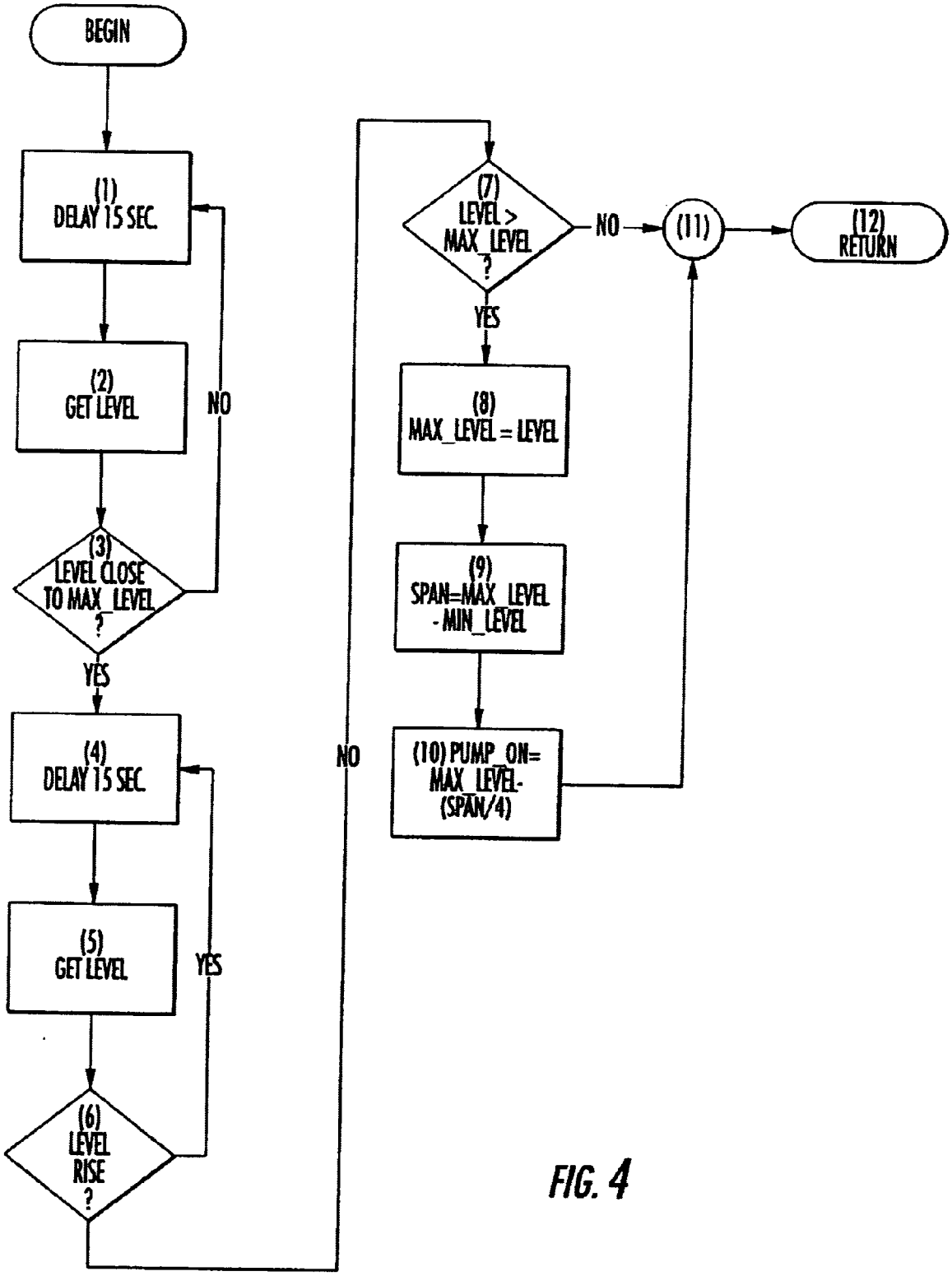
FIG. 4 is a flow chart illustrating steps performed as part of a subroutine of the main program loop to accommodate further variations in the output signal of a level sensor as it corresponds to a level of fluid within a liquid storage container in accordance with an embodiment of the present invention.
Figure 5:
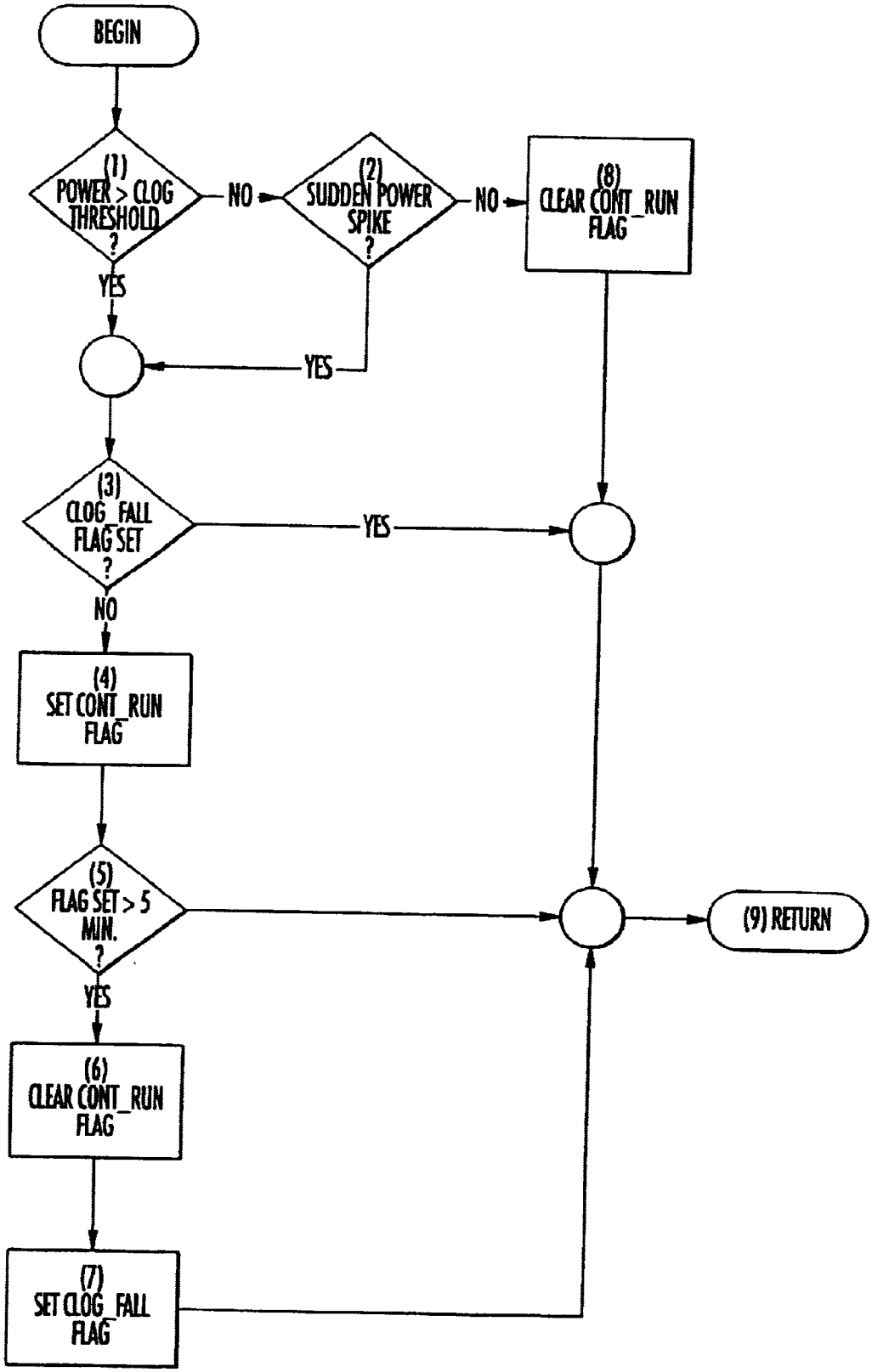
FIG. 5 is a flow chart illustrating steps performed as part of a subroutine of the main program loop to prevent a pump from turning off, or otherwise ceasing to grind debris, while the pump is grinding debris, as appropriate, in accordance with an embodiment of the present invention.

The method steps described above may be implemented in any manner known to those skilled in the art. In one embodiment, the invention may be implemented using the steps shown in FIGS. 2 through 5. FIG. 2 is the main program loop. The main responsibility of this program loop is to turn the pump on and off given input from the level sensor. This program loop also periodically sends a calibration signal to the level sensor and determines if the level sensor output is attenuated due to buildup as described above. If the level sensor is attenuated, this loop calls the functions depicted in FIGS. 3 and 4. By way of explanation, FIGS. 2 through 4 are used, in one embodiment, to implement steps 10, 12, 14, and 16 as shown in FIG. 1. The main program loop (FIG. 2) also checks the output of the clog prevention function as shown in FIG. 5 in order to keep the pump running when requested. The steps shown in FIG. 5 are used, in one embodiment, to implement step 18 of FIG. 1.

The steps of FIG. 2 are as follows.

Step 1: Initialize the microcontroller's systems

Step 2: Load preset Pump On and Pump Off level sensor voltage levels. Normally the system will use these voltage levels to determine when to turn the pump on and off.

Step 3: Clear the Probe Level flag. This software flag is used to indicate if the level sensor span has been re-scaled. If the span has been re-scaled, this flag causes the system to execute the Probe Level function outlined in FIG. 4.

Step 4: Junction

Step 5: Take a reading from the level sensor.

Step 6: If the level reading is greater than or equal to the Pump On level, go to Step 9 and begin the process of turning the pump on. Otherwise, check to see if there is a high alarm.

Step 7: If the level reading input to Step 6 was less than Pump On, but there is a high alarm, the level sensor signal is attenuated due to buildup. In this case, execute the Level Sensor Re-Scale function. If there is no high alarm, go back to Step 5 and take a new level reading.

Step 8: This is the call to the Level Sensor Re-Scale function.

Step 9: Refer to Step 3. If the Probe Level flag is set, it means that the Level Sensor Re-Scale function has re-scaled the tank and that the program should periodically call the Probe Level function. If the flag is not set, go to Step 13 and turn the pump on.

Step 10: The Probe Level function is called every 10 pump cycles. If there has been 10 pump cycles since the last call to Probe Level or since the call to Level Sensor Re-Scale, call the Probe Level function. Otherwise, go to Step 13 and turn on the pump.

Step 11: Call to Probe Level function.

Step 12: Junction

Step 13: Turn the pump on

Step 14: Take a reading from the level sensor.

Step 15: Go to the Clog Prevention function.

Step 16: If the level reading is below the Pump Off level, go to Step 17. Otherwise, take another level reading.

Step 17: See if the Clog Prevention function set the Cont_Run flag. If so, go take another level reading (Step 14). If not, it is ok to turn the pump off. Go to Step 18.

Step 18: This step is the initiation point for the level sensor recalibration routine. The program recalibrates the level sensor every 50 pump cycles. This block tests for the number of elapsed pump cycles since the last recalibration. If there have been more than 50 cycles, start the recalibration process (Step 19). Otherwise, turn the pump off (Step 25).

Step 19: The first step in recalibration is to let the pump remove as much liquid from the tank as possible. Taking frequent level readings, track the tank level down until the level sensor output bottoms out.

Step 20: Run the pump a further 30 seconds to ensure that the tank is pumped down as much as possible.

Step 21: Turn the pump off.

Step 22: Send a calibration signal to the sensor circuitry. The inner workings of the level sensor circuitry are beyond the scope of this program.

Step 23: Reset the number of pump cycles to 0.

Step 24: Junction

Step 25: If the number of pump cycles was less than 50, turn the pump off without recalibrating the sensor.

Step 26: Increment the number of pump cycles and return to Step 5.

FIG. 3 shows the steps performed to re-scale the level sensor as a result of debris buildup on the sensor element. This function is called when the output of the level sensor or level sensor reading is below the value at which the pump will turn on and the system receives a high water alarm (see FIG. 2). In this situation, the pump is submerged and the level sensor output voltage is at its maximum attenuated value due to buildup on the level sensor element. The steps of FIG. 3 are as follows.

Step 1: Store current level as Max_Level.

Step 2: The high alarm overrides this program and turns the pump on directly. Consequently, the pump will remove liquid from the tank and the high alarm float will eventually turn off. Wait for the high alarm to clear.

Step 3: Turn the pump back on.

Step 4: Steps 4–7 track the level sensor output down as the pump removes liquid from the tank. First, take a level reading.

Step 5: If the level reading is less than Max_Level, the tank level is falling into the level sensor's range. Move to Step 6. Otherwise, take another level reading and re-check.

Step 6: Steps 6 and 7 track the water level down until the level sensor's output bottoms out. First, take a level Reading.

Step 7: If the current level is less than the last level reading, return to Step 6 and take a new reading. If the reading did not fall, the water level is at or below the lower limit of the level sensor's range and the tank is almost empty.

Step 8: Run the pump a while longer to ensure that the tank is as empty as possible.

Step 9: Turn off the pump.

Step 10: Take a level reading.

Step 11: Since the tank is now empty, the level sensor reading will be at its lowest value. Store this value (taken in Step 10) as Min_Level.

Step 12: Obtain the span of the level sensor's range by subtracting the Min_Level from the Max_Level.

Step 13: Erase preset Pump On level value and replace it with a new value obtained by subtracting ¼ of the total span obtained in Step 12 from the Max_Level obtained in Step 1.

Step 14: Erase preset Pump Off level value and replace it with a new value obtained by adding ¼ of the total level sensor span obtained in Step 12 to the Min_Level obtained in Step 11. Now both the Pump On and Pump Off level settings are scaled using the attenuated level sensor output. The next pump cycle will therefore trigger not by the backup float, but when the sensor output reaches Pump On.

Step 15: Set the Probe Level flag. The program now "knows" that there is a large buildup on the level sensor. That buildup may fall off. If it does, the span of the level sensor will increase. The program tests for this condition with the Probe Level Function (FIG. 4). By setting the Probe Level flag, this function tells the main program (FIG. 2) that there is a large buildup on the sensor. This in turn causes the main program to periodically call the Probe Level function.

Step 16: Return

FIG. 4 shows the steps performed to perform level probing where the system determines if the debris that caused the level sensor element to become attenuated has fallen off the sensor element. The goal of this function is to track the water level in the tank as it increases. If the level increases beyond the Max_level obtained in the function performed in FIG. 3, it means that some of the buildup fell off of the level sensor element as described in connection with FIG. 1. In this instance, the level sensor span and pump on/pump off levels should be re-scaled. The steps of FIG. 4 are as follows.

Step 1: Delay 15 Seconds.

Step 2: Take a level reading.

Step 3: If the level sensor reading is approaching the Max_Level reading obtained in the Level Sensor Re-Scale function (FIG. 3), go to Step 4. Otherwise, go back to Step 2 and take another level reading.

Step 4: Now the level sensor reading is very close to Max_Level. Continue to allow the water to rise to see if the sensor output rises above Max_Level. To that end, delay 15 seconds.

Step 5: Take a level reading.

Step 6: If the level sensor output is rising, go to Step 4. If the level sensor output did not rise, it may have reached it's maximum possible output. Move to Step 7.

Step 7: If the last level reading taken is greater than Max_Level, go to Step 8 and re-scale the level sensor span. If not, just return.

Step 8: Replace the old Max_Level with the current level reading.

Step 9: Recalculate the level sensor span by subtracting Min_Level (see FIG. 3) from Max_Level.

Step 10: Recalculate the Pump On setting by subtracting ¼ of the level sensor span from Max_Level.

Step 11: Junction

Step 12: Return

FIG. 5 is the clog prevention function and, in one embodiment, includes the steps performed to implement step 18 of FIG. 1. This function determines when the pump is grinding debris by monitoring the output of the power or current sensor. If it determines that the pump is grinding something, this function sets a flag that tells a calling routine to keep the pump running. The steps of FIG. 5 are as follows.

Step 1: Check the pump power draw. If it is over the preset limit, indicating that the pump is grinding something, go to Step 3. Otherwise, go to step 2.

Step 2: Check to see if the pump power/current draw is spiking, but not necessarily spiking up to the preset limit (see Step 1). A spike is represented by a sudden increase in power draw. If this occurs, go to Step 3. If there is no power spike, or the spike has ended, go to Step 8.

Step 3: Check to see if the Clog_Fail flag is set. If so, it means that this routine has already tried and failed to prevent a clog. Go to Step 9 and exit this function. Otherwise, go to Step 4.

Step 4: Set the Cont_Run (Continue to Run) flag. This tells the main program not to turn off the pump.

Step 5: If this function has kept the Cont_Run flag set for more than five minutes, go to Step 6. Otherwise, go to Step 9.

Step 6: Clear the Cont_Run flag. Clearing the Cont_Run flag (thus allowing the main program to turn the pump off) after five minutes (or other suitable time period) will protect the pump from becoming damaged due to running continuously.

Step 7: Set the Clog_Fail flag. This flag notifies subsequent calls to this function that the clog prevention failed and should not be attempted again.

Step 8: Clear the Cont_Run flag. This allows the main program to turn the pump off at the appropriate water level.

Step 9: Return to calling routine.

Figure 6:
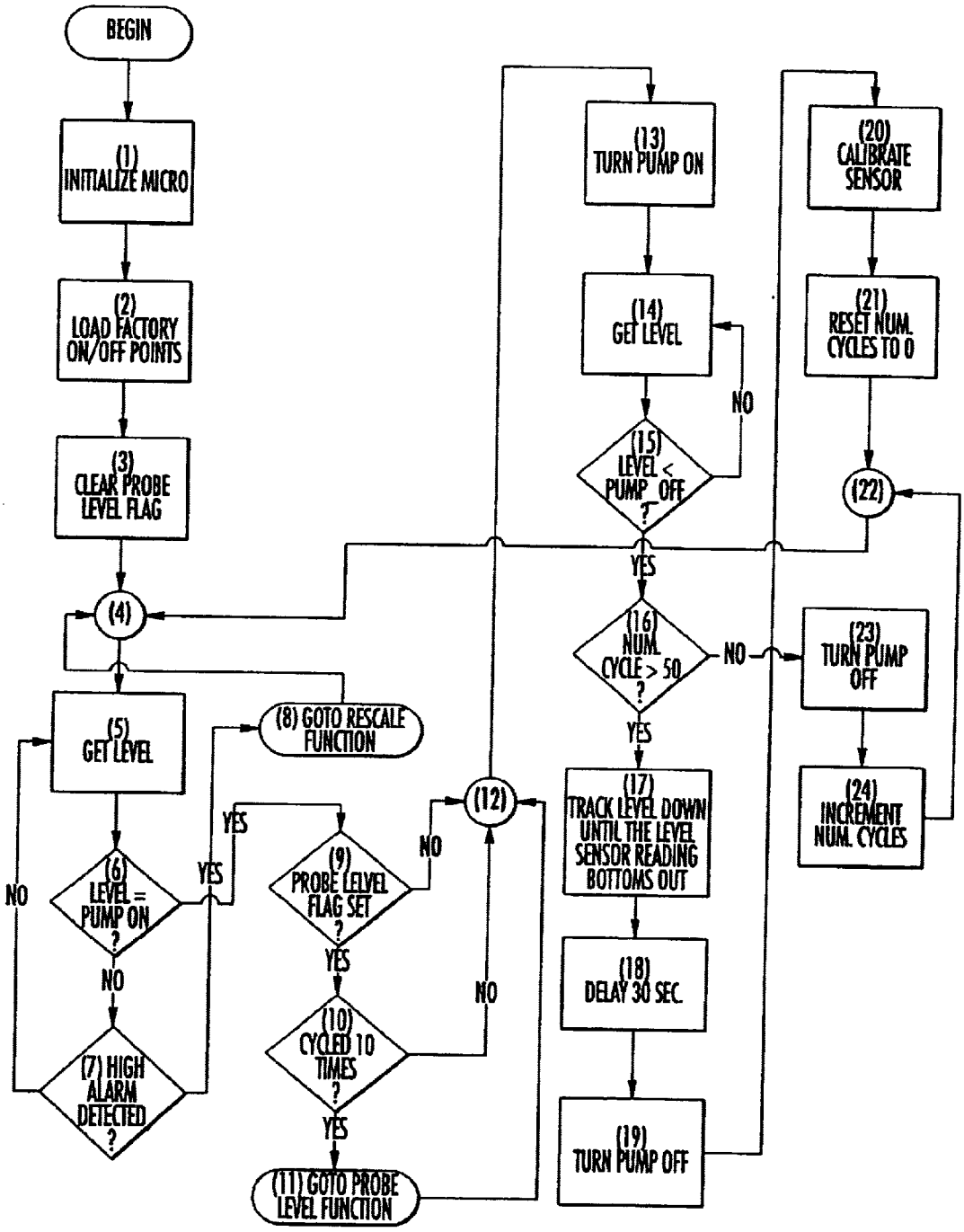
FIG. 6 is a flow chart illustrating steps performed as part of a main program loop where the main program loop is performed without the clog prevention subroutine shown in FIG. 5 in accordance with an embodiment of the present invention.

The present invention may also be implemented without use of the clog prevention function as desired. In that case, for the embodiment described in FIGS. 2 through 5, FIGS. 3 and 4 remain the same while the main program loop (FIG. 2) is adjusted so as to include the steps indicated in FIG. 6. The steps of FIG. 6 are as follows.

Step 1: Initialize the microcontroller's systems

Step 2: Load preset Pump On and Pump Off level sensor voltage levels. Normally the system will use these voltage levels to determine when to turn the pump on and off.

Step 3: Clear the Probe Level flag. This software flag is used to indicate if the level sensor span has been re-scaled. If the span has bee re-scaled, this flag causes the system to execute the Probe Level function outlined in FIG. 4.

Step 4: Junction

Step 5: Take a reading from the level sensor.

Step 6: If the level reading is greater than or equal to the Pump On level, go to Step 9 and begin the process of turning the pump on. Otherwise, check to see if there is a high alarm.

Step 7: If the level reading input to Step 6 was less than Pump On, but there is a high alarm, the level sensor signal is attenuated due to buildup. In this case, execute the Level Sensor Re-Scale function. If there is no high alarm, go back to Step 5 and take a new level reading.

Step 8: This is the call to the Level Sensor Re-Scale function.

Step 9: Refer to Step 3. If the Probe Level flag is set, it means that the Level Sensor Re-Scale function has re-scaled the tank and that the program should periodically call the Probe Level function. If the flag is not set, go to Step 13 and turn the pump on.

Step 10: The Probe Level function is called every 10 pump cycles. If there have been 10 pump cycles since the last call to Probe Level or since the call to Level Sensor Re-Scale, call the Probe Level function. Otherwise, go to Step 13 and turn on the pump.

Step 11: Call to Probe Level function.

Step 12: Junction

Step 13: Turn the pump on

Step 14: Take a reading from the level sensor.

Step 15: If the level reading is below the Pump Off level, go to Step 16. Otherwise, take another level reading.

Step 16: This step is the initiation point for the level sensor recalibration routine. The program recalibrates the level sensor every 50 pump cycles. This block tests for the number of elapsed pump cycles since the last recalibration. If there have been more than 50 cycles, start the recalibration process (Step 17). Otherwise, turn the pump off (Step 23).

Step 17: The first step in recalibration is to let the pump remove as much liquid from the tank as possible. Taking frequent level readings, track the tank level down until the level sensor output bottoms out.

Step 18: Run the pump a further 30 seconds to ensure that the tank is pumped down as much as possible.

Step 19: Turn the pump off

Step 20: Send a calibration signal to the sensor circuitry. The inner workings of the level sensor circuitry are beyond the scope of this program.

Step 21: Reset the number of pump cycles to 0.

Step 22: Junction

Step 23: If the number of pump cycles was less than 50, turn the pump off without recalibrating the sensor.

Step 24: Increment the number of pump cycles and return to Step 5.

While specific examples for implementing the invention are provided above, the invention may be implemented as desired. The implementation examples provided above may be adjusted as desired to perform the functions of the invention as desired.

Figure 7:
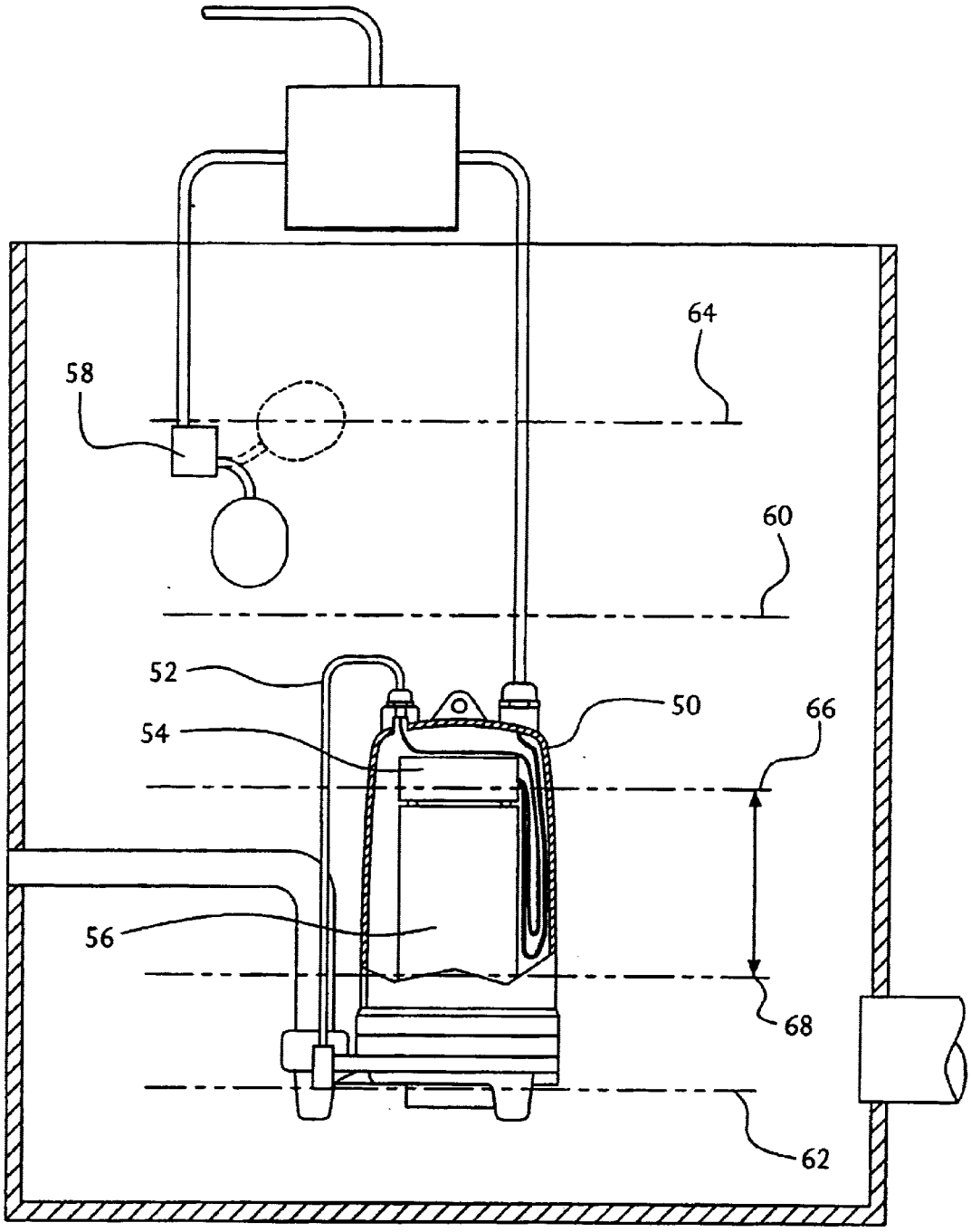
FIG. 7 is a diagram of components included in a system for adjusting operating parameters of a computer controlled pump so as to account for solids encountered during a pumping operation in accordance with the present invention.

The system of the present invention, shown in FIG. 7, comprises in one embodiment, at least one pump 50, a level sensor 52, and at least one microprocessor for monitoring the values of the output signal and updating them as needed. The system may also include at least one microprocessor for monitoring pump power draw so as to ensure the pump does not turn off while grinding debris. The microprocessors, which obviously are not limited to one but rather may be any number as required, are located within a control box 54 above the pump motor 56. The microprocessor for monitoring the values of the output signal and updating them as needed, may make use of a high alarm float 58 or any other level sensing device so as to provide information regarding possible overflow situations. A junction box may also be provided, as is typically done in the art, to connect the pump, high alarm float, power source and central control station. While the microprocessors are indicated as being located in the control box 54, the microprocessors so described as well as any additional microprocessors may be located anywhere as desired.

The pump control system may be used in any type of pumping operation but is especially useful for pumping operations where solids may be encountered. As discussed earlier, solids are often problematic in pumping operations in that they may cause a level sensor to become attenuated and may also result in the pump becoming jammed, for example.

To address the problem of the level sensor becoming attenuated, at least one microprocessor is provided that works in conjunction with the level sensor, high alarm float and pump so as to monitor changes in the values of the output signal as they relate to fluid level. In FIG. 7, maximum fluid level is indicated by reference numeral 60. Continuing with the example present earlier, the value predetermined as corresponding to the maximum fluid level is 3.5 VDC. The minimum fluid level is 62 and the value predetermined as corresponding thereto is 0.5 VDC. When the fluid level rises above the maximum fluid level 60 and eventually triggers the high alarm float 58 at a particular fluid level 64 designated as corresponding thereto, a signal is sent from the high alarm float to the a microprocessor. A first reading of the value of the output signal is taken and stored as the value of the output signal corresponding to the maximum fluid level. The fluid is then pumped down to the minimum fluid level 62 where a second reading of the value of the output signal is taken and stored as the value of the output signal that corresponds to the minimum fluid level 62. Using those new output signal values, the values of the output signal that corresponds to the fluid levels at which the pump will turn on and off are recalculated. The fluid levels at which the pump will turn on and off are shown as 66 and 68 respectively.

By way of example, assume the value of the first reading taken above is 1.5 VDC. That means the value of the output signal that now corresponds to the maximum fluid level 60 is 1.5 VDC. The variation in the value is often due to attenuation caused by solids attaching to the level sensor element 52. Those solids while being prone to stick to the sensor 52, quite often fall off the sensor 52 during a pumping operation thereby contributing to the possibility that the values of the output signal may need further adjustment. Accordingly, the system allows the fluid level to periodically rise above the maximum fluid level 60 to determine if further adjustments are necessary. The high alarm and recalculation performed in response thereto resulted in the value of the output signal corresponding to the maximum fluid level being reduced from 3.5 VDC to 1.5 VDC. With that in mind, if the value of the output signal that corresponds to the maximum fluid level rises when the fluid level is allowed to rise past 60, that means some or all of the debris may have fallen off the element 52 depending on how close the output signal value gets to 3.5 VDC. When the value does rise, whatever value it rises to is stored as the value of the output signal that corresponds to the maximum fluid level 60. The other values of the output signal i.e. the value that corresponds to the minimum fluid level as well as the values at which the pump turns on and off, are also adjusted accordingly.

The other microprocessor or set of microprocessors, depending on how the system is implemented, monitor power drawn by the pump and if the power draw indicates the pump is grinding solids, the pump 50 will be forced to keep grinding the solids until they are removed from the pump 50. The process of monitoring power draw was described above and, for the sake of brevity, will not be described further.

Figure 8:
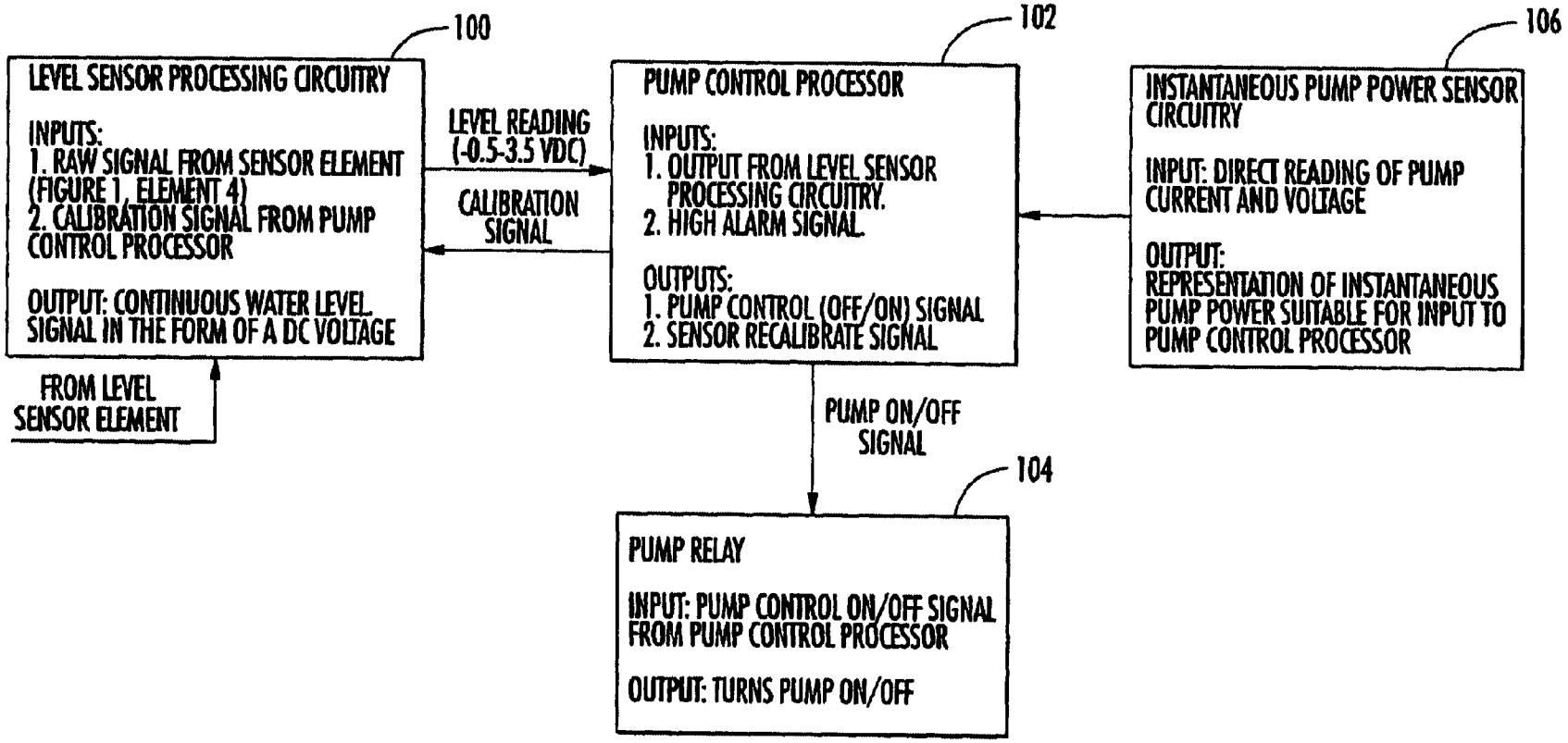
FIG. 8 is a pump(s) control functional block diagram wherein the main program loop will be implemented using the clog prevention subroutine in accordance with an embodiment of the present invention.
Figure 9:
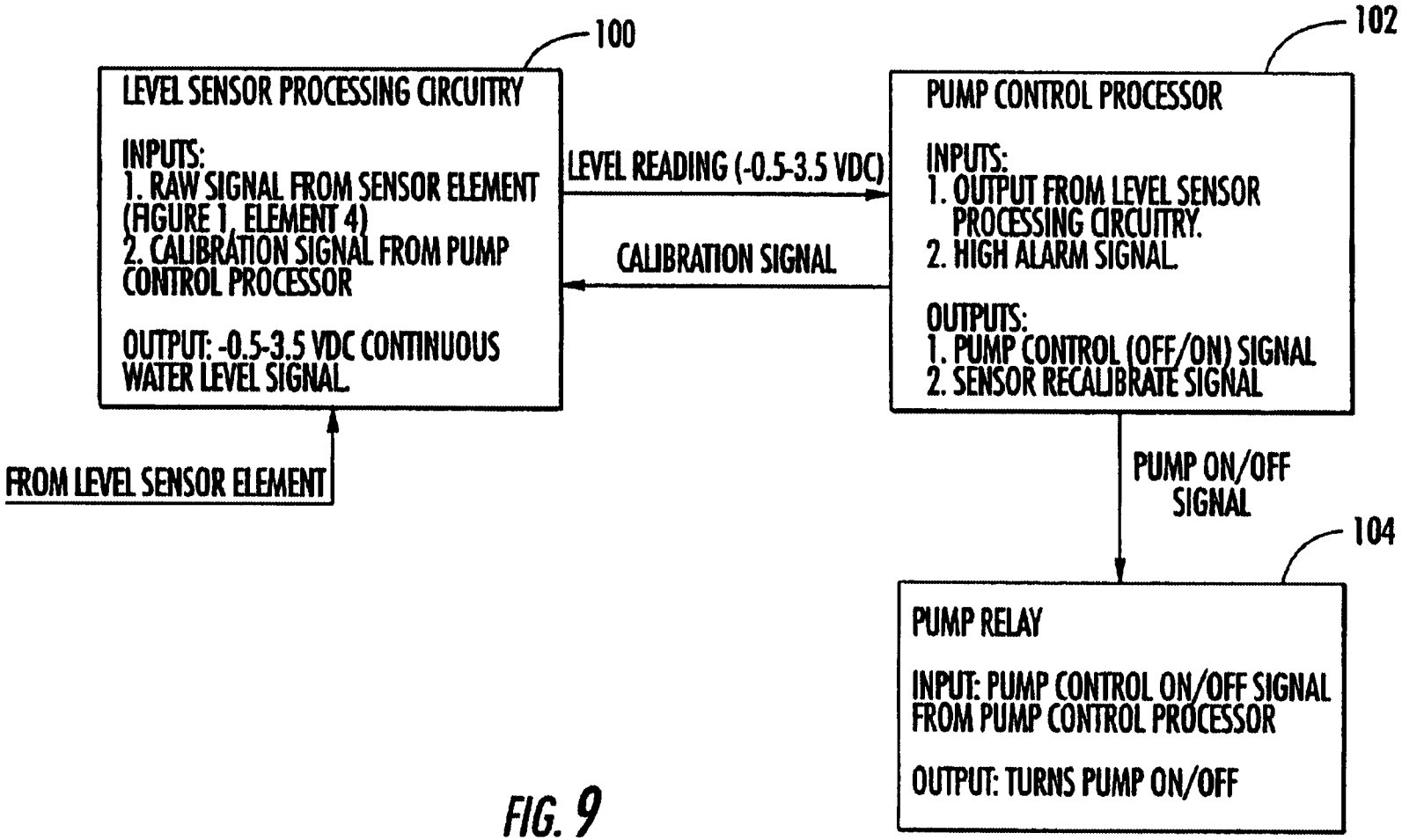
FIG. 9 is a pump(s) control function block diagram wherein the main program loop will be implemented without using the clog prevention subroutine in accordance with an embodiment of the present invention.
Figure 2:
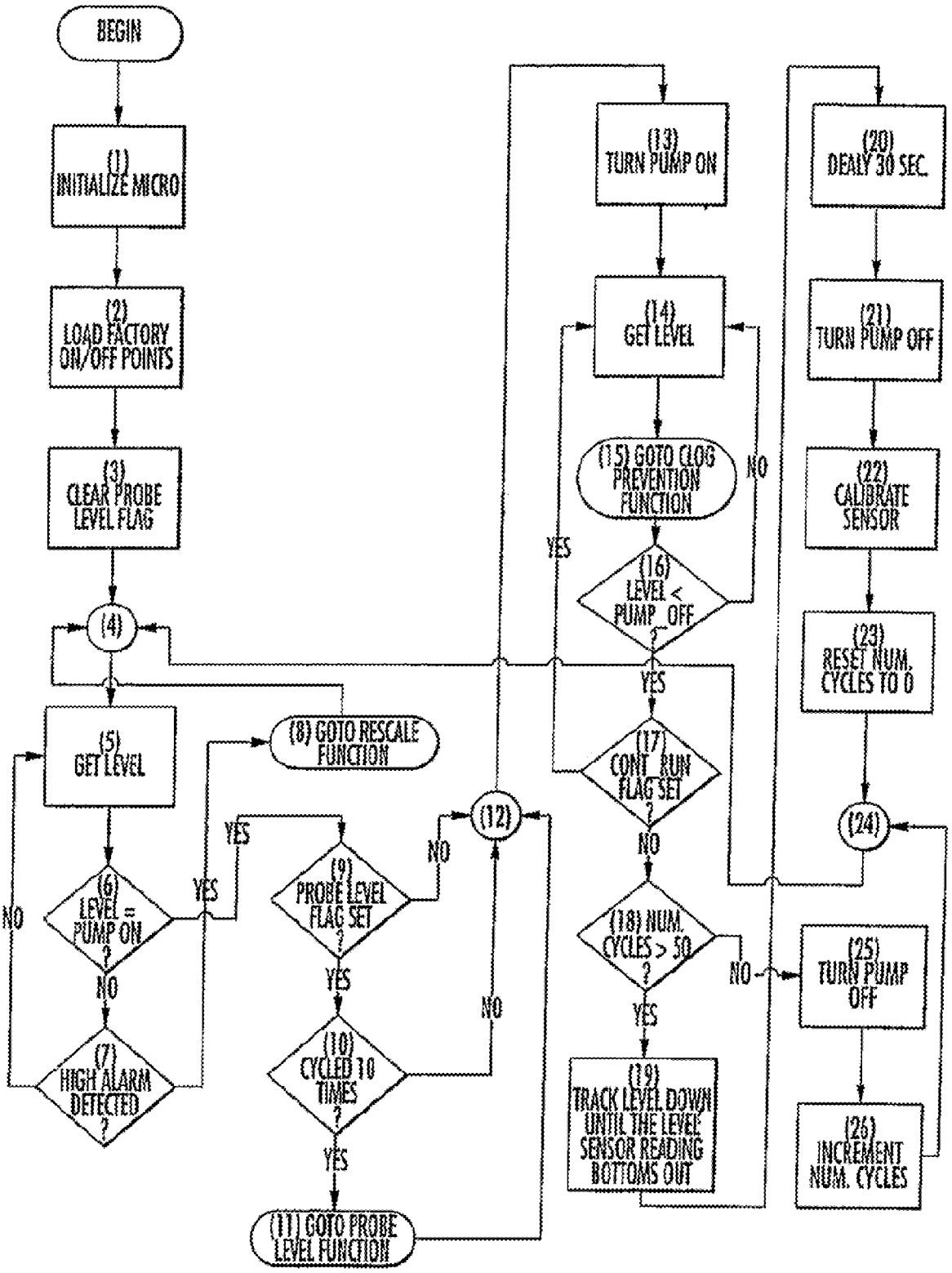
Figure 5:
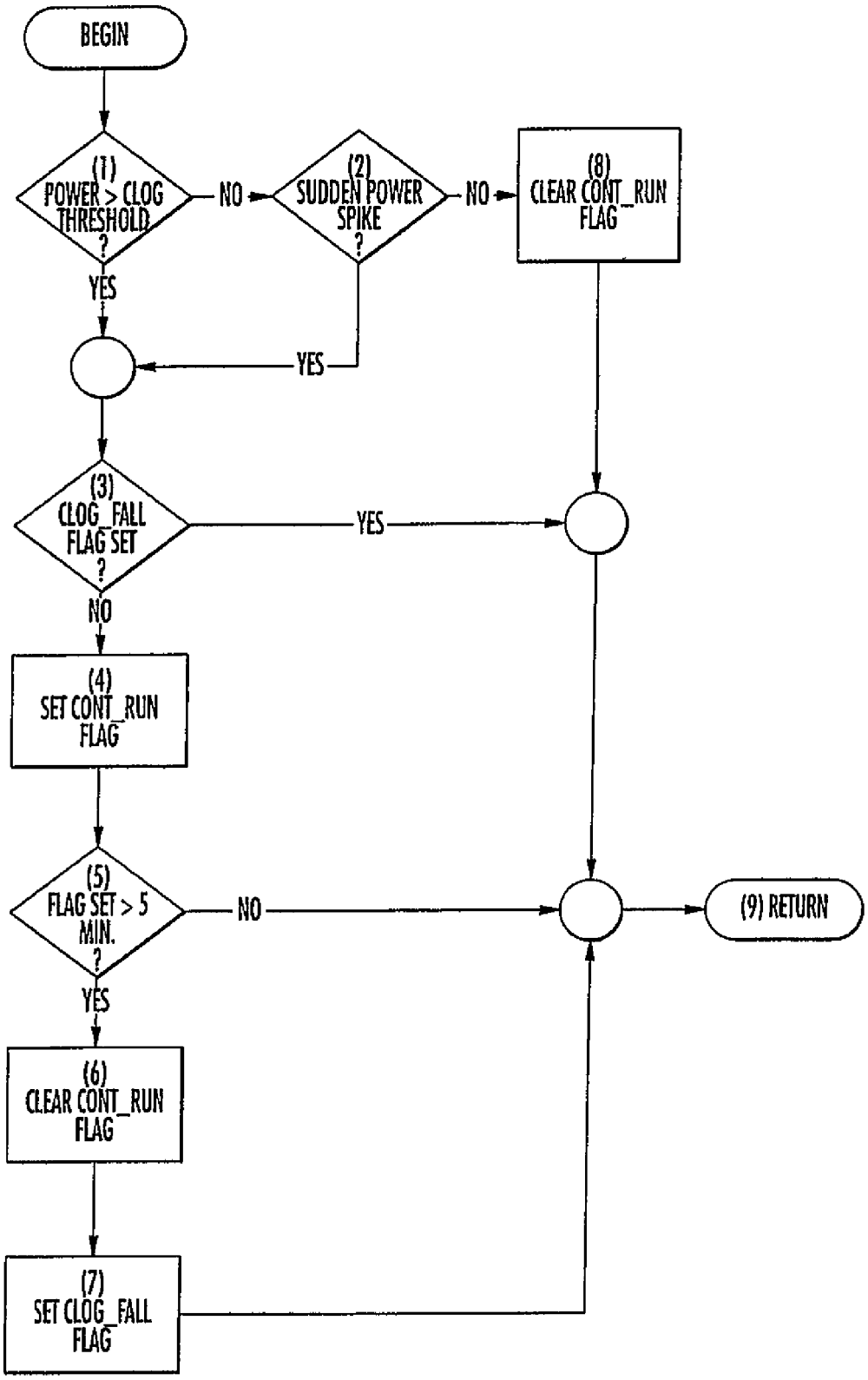

In a preferred embodiment, system control elements may be arranged according to a pump(s) control functional block diagram as shown in FIG. 8. In FIG. 8, level control processing circuitry is provided and indicated generally with reference numeral 100. The circuitry 100 receives inputs from the level sensor element (see FIG. 7, numeral 52). In one embodiment, the inputs are a raw signal from the sensor element and a calibration signal from pump control processor. The circuitry 100 provides a continuous water level signal in the form of a DC voltage. A pump control processor 102 is also provided. The processor's 102 input is the output from the level sensor processing circuitry 100 and the high alarm signal. The processor's 102 output is a pump control (on/off signal and a sensor recalibrate signal. A pump relay 104 is also provided. The pump relay's 104 input is the pump control on/off signal from the pump control processor. The pump relay's 104 turns the pump on and off. Instantaneous pump power sensor circuitry 106 is also provided. The circuitry's 106 input is a direct reading of pump current and voltage while it's output is a representation of instantaneous pump power suitable for input to the pump control processor 102.

Where the invention is implemented without the clog prevention function, the pump(s) control function block diagram is adapted as shown in FIG. 9. In such an embodiment, the instantaneous pump power sensor circuitry 106 is not included.

The present invention may be embodied in other specific forms without departing from the spirit or essential attributes thereof.

What is claimed is:

1. A method for adjusting pump operating parameters for at least one pump to accommodate solids encountered during a pumping operation, the method comprising the steps of:

a) providing a level sensor adapted to provide an output signal corresponding to a fluid level;

b) assigning a value of the output signal to correspond to a predetermined maximum fluid level;

c) assigning a value of the output signal to correspond to a predetermined minimum fluid level;

d) programming the pump to turn on when the output signal is at a certain predetermined value and off when the output signal is at another predetermined value, the predetermined values being less than the value that corresponds to the maximum fluid level and greater than the value that corresponds to the minimum fluid level; and e) monitoring the values of the output signal that correspond to the maximum and minimum fluid levels so as to periodically update the values at which the pump will turn on and off in accordance with variations that may occur in the values of the signal that correspond to the maximum and minimum fluid levels.

2. The method of claim 1 wherein the step of monitoring the values of the output signal that correspond to the maximum and minimum fluid levels comprises;

a) taking a first reading of the value of the output signal generated by the level sensor in response to an alarm signal indicating that the level of fluid is above the maximum fluid level and that the pump has not begun pumping;

b) adjusting the value of the output signal that corresponds to the maximum fluid level so that the value of the output signal taken as the first reading corresponds to the maximum fluid level;

c) reducing the level of fluid to below the minimum fluid level;

d) taking a second reading of the value of the output signal generated by the level sensor while the fluid level is below the minimum fluid level;

e) adjusting the value of the output signal that corresponds to the minimum fluid level so that the value of the output signal taken as the second reading corresponds to the minimum fluid level; and f) using the values of the output signal taken as the first and second reading to calculate new output signal values at which the pump will turn on and off.

3. The method of claim 2 comprising the additional steps of:

a) continuing to monitor the values of the output signal taken as the first and second reading so as to detect any further variations in the values of the output signal that correspond to the maximum and minimum fluid levels; and b) adjusting the values of the output signal at which the pump will turn on and off in accordance with any variations detected in the values of the output signal that correspond to the maximum and minimum fluid levels.

4. The method of claim 3 wherein the step of continuing to monitor the values of the output signal taken as the first and second reading further comprises:

a) allowing the fluid level to periodically rise above the maximum fluid level at predetermined intervals.

5. The method of claim 4 further comprising the step of determining whether the pump is grinding debris so that when the pump is grinding debris, the pump may continue grinding the debris regardless of whether the value of the output signal is below the value at which the pump would otherwise turn off.

6. The method of claim 5 wherein the step of determining whether the pump is grinding debris further comprises:

a) monitoring the power draw of the pump.

7. The method of claim 1 wherein the variations in the values of the output signal that correspond to the maximum and minimum fluid levels occur as a result of solids becoming attached to the level sensor.

8. The method of claim 1 wherein the value of the output signal that corresponds to the maximum fluid level is a range of values.

9. The method of claim 1 wherein the value of the output signal that corresponds to the minimum fluid level is a range of values.

10. A method for adjusting pump operating parameters for at least one pump to accommodate solids encountered during a pumping operation, the method comprising the steps of:

a) providing a level sensor adapted to provide an output signal corresponding to a fluid level;

b) assigning a value of the output signal to correspond to a predetermined maximum fluid level;

c) assigning a value of the output signal to correspond to a predetermined minimum fluid level;

d) programming the pump to turn on when the output signal is at a certain predetermined value and off when the output signal is at another predetermined value, the predetermined values being less than the value that corresponds to the maximum fluid level and greater than the value that corresponds to the minimum fluid level;

e) monitoring the values of the output signal that correspond to the maximum and minimum fluid levels so as to periodically update the values at which the pump will turn on and off in accordance with variations that may occur in the values of the signal that correspond to the maximum and minimum fluid levels; and f) determining whether the pump is grinding debris so that when the pump is grinding debris, the pump may continue grinding the debris regardless of whether the value of the signal is below the value at which the pump would otherwise turn off.

11. A method for adjusting pump operating parameters for at least one pump to accommodate solids encountered during a pumping operation, the method comprising the steps of:

a) providing a level sensor adapted to provide an output signal corresponding to a fluid level;

b) assigning a value of the output signal to correspond to a predetermined maximum fluid level;

c) assigning a value of the output signal to correspond to a predetermined minimum fluid level;

d) programming the pump to turn on when the output signal is at a certain predetermined value and off when the output signal is at another predetermined value, the predetermined values being less than the value that corresponds to the maximum fluid level and greater than the value that corresponds to the minimum fluid level;

e) taking a first reading of the value of the output signal generated by the level sensor in response to an alarm signal indicating that the level of fluid is above the maximum fluid level and that the pump has not begun pumping;

f) adjusting the value of the output signal that corresponds to the maximum fluid level so that the value of the output signal taken as the first reading now corresponds to the maximum fluid level;

g) reducing the level of fluid to below the minimum fluid level;

h) taking a second reading of the value of the output signal generated by the level sensor while the fluid level is below the minimum fluid level;

i) adjusting the value of the output signal that corresponds to the minimum fluid level so that the value of the output signal taken as the second reading now corresponds to the minimum fluid level; and j) using the values of the output signal taken as the first and second reading to calculate new output signal values at which the pump will turn on and off.

12. The method of claim 11 further comprising the steps of:

a) continuing to monitor the values of the output signal taken as the first and second reading so as to detect any further variations in the values of the output signal that correspond to the maximum and minimum fluid levels; and b) adjusting the values of the output signal at which the pump will turn on and off in accordance with any variations detected in the values of the output signal that correspond to the maximum and minimum fluid levels.

13. The method of claim 12 wherein the step of continuing to monitor the value of the output signal taken as the first reading further comprises:

a) allowing the fluid level to periodically rise above the maximum fluid level at predetermined intervals.

14. The method of claim 13 further comprising the steps of:

a) determining whether the pump is grinding debris so that when the pump is grinding debris, the pump may continue grinding the debris regardless of whether the value of the output signal is below the value at which the pump would otherwise turn off.

15. The method of claim 14 wherein the step of determining whether the pump is grinding debris further comprises:

a) monitoring the power draw of the pump.

16. A method for adjusting pump operating parameters for at least one pump to accommodate solids encountered during a pumping operation, the method comprising the steps of:

a) providing a level sensor adapted to provide an output signal corresponding to a fluid level;

b) assigning a value of the output signal to correspond to a predetermined maximum fluid level;

c) assigning a value of the output signal to correspond to a predetermined minimum fluid level;

d) programming the pump to turn on when the output signal is at a certain predetermined value and off when the output signal is at another predetermined value, the predetermined values being less than the value that corresponds to the maximum fluid level and greater than the value that corresponds to the minimum fluid level;

e) taking a first reading of the value of the output signal generated by the level sensor in response to an alarm signal indicating that the level of fluid is above the maximum fluid level and that the pump has not begun pumping;

f) adjusting the value of the output signal that corresponds to the maximum fluid level so that the value of the output signal taken as the first reading corresponds to the maximum fluid level;

g) reducing the level of fluid to below the minimum fluid level;

h) taking a second reading of the value of the output signal generated by the level sensor while the fluid level is below the minimum fluid level;

i) adjusting the value of the output signal that corresponds to the minimum fluid level so that the value of the output signal taken as the second reading corresponds to the minimum fluid level;

j) using the values of the output signal taken as the first and second reading to calculate new output signal values at which the pump will turn on and off;

k) continuing to monitor the values of the output signal taken as the first and second reading so as to detect any further variations in the values of the output signal that correspond to the maximum and minimum fluid levels;

l) adjusting the values of the output signal at which the pump will turn on and off in accordance with any variations detected in the values of the output signal that correspond to the maximum and minimum fluid levels; and m) determining whether the pump is grinding debris so that when the pump is grinding debris, the pump may continue grinding the debris regardless of whether the value of the output signal is below the value at which the pump would otherwise turn off.

17. A pump control system wherein pump operating parameters of at least one pump may be adjusted to accommodate solids encountered during a pumping operation, the system comprising:

a) at least one pump;

b) a level sensor adapted to provide an output signal corresponding to a fluid level wherein a value of the output signal is predetermined to correspond to a predetermined maximum fluid level and a value of the output signal is predetermined to correspond to a predetermined minimum fluid level;

c) the system being adapted to cause the pump to turn on when the output signal is at a certain level and off when the output signal is at another predetermined value wherein the predetermined values are within the range of values that correspond to the minimum and maximum fluid levels;

d) at least one microprocessor adapted to monitor the output signal of the level sensor and periodically recalculate the values of the output signal at which the pump will turn on and off in accordance with variations that may occur in the values of the output signal that correspond to the maximum and minimum fluid levels; and e) at least one microprocessor adapted to determine whether the pump is grinding debris so that when the pump is grinding debris, the pump may continue grinding the debris regardless of whether the value of the output signal is below the value at which the pump would otherwise turn off.

18. A method of adjusting pump operating parameters for at least one pump to accommodate solids encountered during a pumping operation, the method comprising the steps of:

a) providing a level sensor adapted to provide an output signal corresponding to a fluid level;

b) programming the pump to begin pumping when the level of fluid rises above a predetermined maximum fluid level and stop pumping when the level of fluid falls below a predetermined minimum fluid level by assigning a value of the output signal to correspond to the maximum fluid level and a value of the output signal to correspond to the minimum fluid level; and c) monitoring the values of the output signal that correspond to the maximum and minimum fluid levels so as to periodically update the values of the output signal that correspond to the maximum and minimum fluid levels in accordance with variations that may occur in the values of the output signal that correspond to the maximum and minimum fluid levels.

19. The method of claim 18 further comprising the step of determining whether the pump is grinding debris so that when the pump is grinding debris, the pump may continue grinding the debris regardless of whether the value of the output signal is below the value at which the pump would otherwise stop pumping.

* * * * *

UNITED STATES PATENT AND TRADEMARK OFFICE

CERTIFICATE OF CORRECTION

PATENT NO. : 6,638,023 B2
APPLICATION NO. : 10/041288
DATED : October 28, 2003
INVENTOR(S) : Scott It is certified that error appears in the above-identified patent and that said Letters Patent is hereby corrected as shown below:

The drawing sheets 2 and 5, consisting of Figs. 2 and 5, should be deleted to be replaced with drawing sheet consisting of Figs. 2 and 5, as shown on the attached pages.

Signed and Sealed this

Twenty-third Day of October, 2007

JON W. DUDAS
*Director of the United States Patent and Trademark Office*